US007134951B1

(12) United States Patent
Leon et al.

(10) Patent No.: US 7,134,951 B1
(45) Date of Patent: Nov. 14, 2006

(54) SHEET HOLDER FOR ABRASIVE SHEETS

(76) Inventors: Jess M. Leon, 526 W. Norman Ave., Arcadia, CA (US) 91007; Jeff M. Leon, 526 W. Norman Ave., Arcadia, CA (US) 91007

( * ) Notice: Subject to any disclaimer, the term of this patent is extended or adjusted under 35 U.S.C. 154(b) by 0 days.

(21) Appl. No.: 11/320,148

(22) Filed: Dec. 28, 2005

(51) Int. Cl.
*B24D 17/00* (2006.01)

(52) U.S. Cl. ..... 451/520; 451/356; 451/522

(58) Field of Classification Search ..... 451/356, 451/357, 490, 495, 499, 500, 514, 520, 522
See application file for complete search history.

(56) References Cited

U.S. PATENT DOCUMENTS 4,075,793 A 2/1978 Vogel et al.
4,077,165 A 3/1978 Hutchins
4,216,631 A 8/1980 Ryer, II
4,475,317 A 10/1984 Dicke
4,625,462 A * 12/1986 Fushiya et al. ..... 451/357
4,922,663 A 5/1990 Nakagawa et al.
5,616,072 A 4/1997 Walz et al.
5,902,176 A * 5/1999 Chen ..... 451/524
6,626,746 B1 9/2003 Mayr et al.
6,641,469 B1 * 11/2003 Deshler ..... 451/514
6,857,948 B1 2/2005 Bocka et al.
6,887,143 B1 * 5/2005 Bocka et al. ..... 451/359
6,935,936 B1 * 8/2005 Goulet et al. ..... 451/344

* cited by examiner

*Primary Examiner*—Dung Wan Nguyen
(74) *Attorney, Agent, or Firm*—Donald D. Mon

(57) ABSTRACT

A holder for flexible abrasive sheets. An abrasive sheet is gripped by a gripper actuated by a rotationally mounted cam pin that reciprocates a cam plate which pulls an edge of the sheet tightly against a backing surface so it can respond to oscillation of a sander to which the holder is mounted.

11 Claims, 4 Drawing Sheets

SHEET HOLDER FOR ABRASIVE SHEETS

FIELD OF THE INVENTION

Mounting of abrasive sheets such as sandpaper and emery paper to a holder which can be manually or mechanically moved to abrade or smooth a surface.

BACKGROUND OF THE INVENTION

While abrasive sheets such as sandpaper and emery paper are stiffly flexible and are often directly pressed against a surface to be smoothed or suitably abraded, it is more common practice to mount the paper to a holder which can more readily be manipulated, or which can be attached to an appliance that vibrates or orbits it on the surface.

This is far from a new concept and the art is replete with examples of useful holders for this purpose. One is entitled to be surprised to learn that there is still room for improvement.

It is clear that the prior art provides holders to which abrasive sheets can be attached. Any one of them, once the sheet is applied, can usefully be employed for the same purpose. The problem that remains is getting the sheet on the holder with least effort, least exposure to injury to the hand, and with sufficient retention to resist wrinkling of the sheet and relative in-plane movement between the sheet and the holder during vigorous operation.

It is an object of this invention to enable user to take a loose sheet of abrasive material, readily insert it into an opening at one end, and equally readily to insert the other end into an opposite-facing opening and lock both ends in place with the sheet brought tightly against the holder, stressed and ready for use.

BRIEF DESCRIPTION OF THE INVENTION

A sheet holder according to this invention, while useful with a manual "block", is principally intended for use as an accessory for a powered sander, which may be vibratory or orbital.

It includes a base plate with a flat backing surface having a pair of spaced apart parallel edges. It is intended that a strip or sheet of abrasive material such as sandpaper be wrapped around both edges and drawn tightly so there is no slack in the sheet and it bears tightly against the backing surface.

According to this invention, at each edge, supported on and movable on the back side of the holder is a gripper with an engagement lip directed toward the back side of the base plate and adapted to hold and draw the strip. The gripper is movable parallel to the back side of the base plate for this purpose.

A rotary actuator mounted to the holder includes a cam system reactive with the gripper, whereby rotation os a handle on the actuator causes the edges of the sheet to be drawn toward each other, tightening the sheet and thereby holding the sheet tightly against the backing surface.

The holder can optionally be attached to a block to be held by the hand, or mounted to a powered vibratory or orbital mechanism, often replacing the holder that already may be provided on the mechanism.

The above and other features of this invention will be fully understood from the following detailed description and the accompanying drawings, in which:

DETAILED DESCRIPTION OF THE INVENTION

Figure 2:
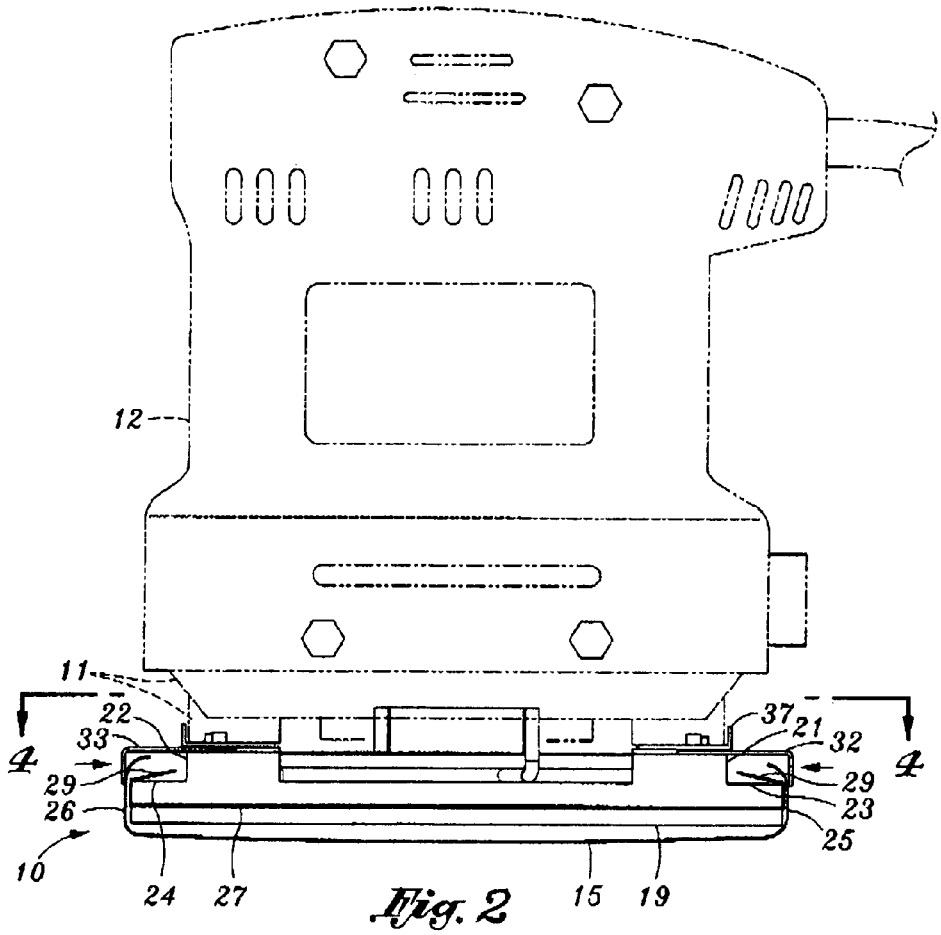
FIG. 2 is a side view of the assembly with the sheet loosely engaged.
Figure 3:
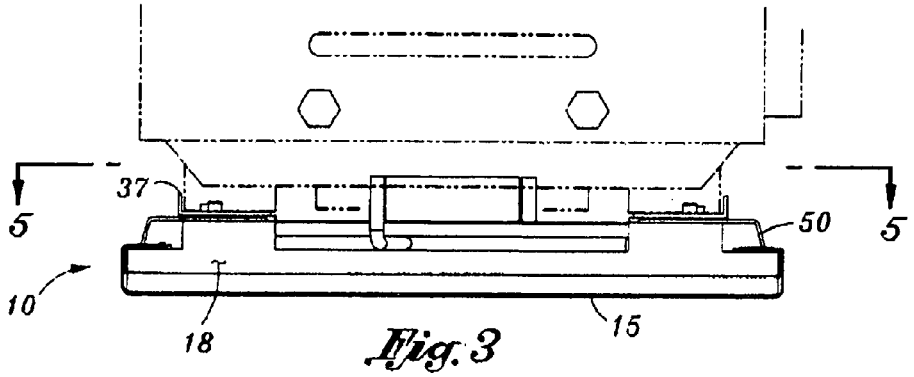
FIG. 3 is a side view similar to FIG. 2 with the sheet tightly engaged.

A holder 10 shown in FIGS. 2 and 3 mounted to the base 11 of a powered sander 12. The sander may be of any desired type, for example vibratory or orbital in plane normal to the drawing.

Figure 1:
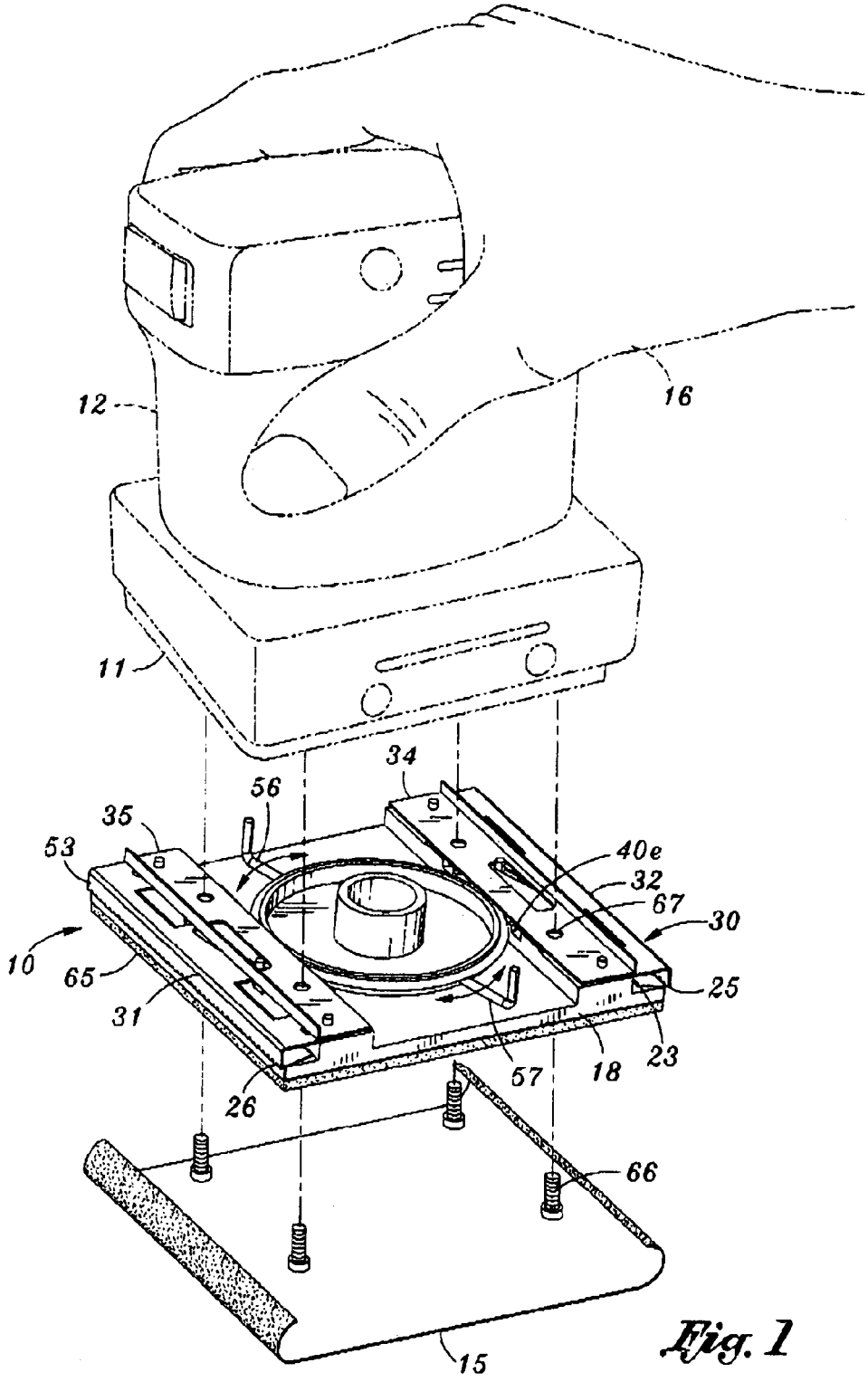
FIG. 1 is an exploded view of the holder and sander assembly.

Its purpose is to hold a sheet 15 of abrasive material, for example sandpaper or emery paper, to the holder so the sheet will move with the holder in response to forces exerted by the sander. In FIG. 1, a hand 16 is shown gripping the sander. If desired, the holder may be used separately from the sander, and directly held. Alternately a block (not shown) may be substituted for the sander to provide a good grip.

In FIG. 2, the sheet is shown loosely on the holder. In FIG. 3 the holder has been actuated to draw the sheet tightly to the holder.

The holder includes a rigid base plate 18 having a flat backing surface 19 on its lower side. On its upper side there are two parallel strips 21,22. Strips 21 and 22 provide gripping surfaces 23,24 adjacent to parallel edge 25,26 of the base plate. The edges may be somewhat rounded if desired.

Also if desired, a metal shroud 27 (FIGS. 2 and 6) can be wrapped around the bottom of base plate 18 with a central portion 28 bearing against surface 19. The central portion may be considered part of the backing surface when it is used.

Shroud 27 includes springy flanges 29 that overhang gripping surfaces 23 and 24 when the shroud is used, these act as gripping surfaces against which the sheet will bear.

A gripper 30,31, comprises a cam plate 32,33 axially reciprocable between the upper surface of the base plate and a respective cover plate 34,35 (FIG. 1). The cover plates are fixed to the base plate by screws 66 and have an upwardly-turned flange 37 to stiffen the cover plate.

Figure 4:
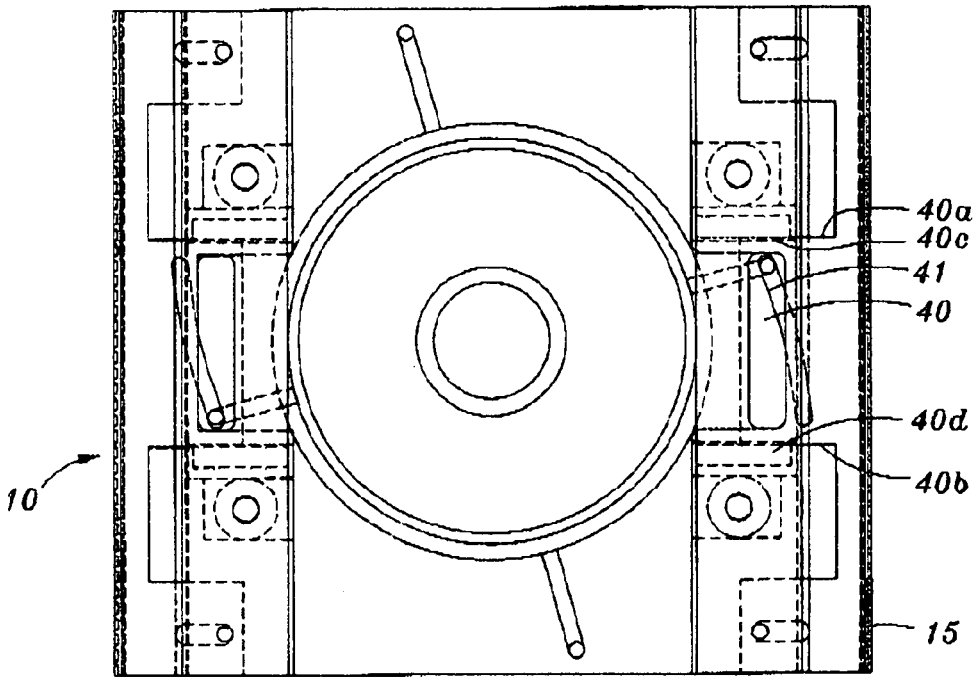
FIG. 4 is a top view of the holder in the condition of FIG. 2 with the sheet loosely engaged.
Figure 5:
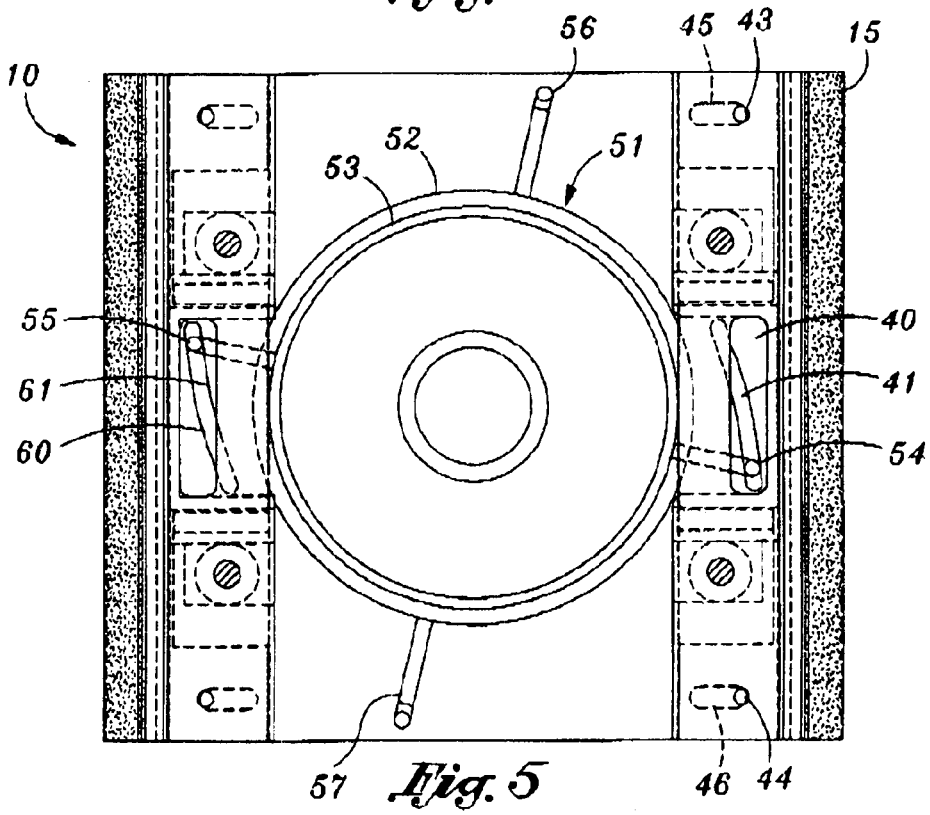
FIG. 5 is a top view of the holder in the condition of FIG. 3, with the sheet tightly engaged.

Both grippers are identical, so only gripper 30 will be described in detail. Each cam plate has a central portion 40 (FIGS. 4 and 5) with a cam slot 41 through it. The central portion 40 is bounded on two opposite parallel sides by guide surfaces 40*a* and 40*b*, that are normal to the gripper edge where the sheet is to be attached. Guide surfaces 40*c* and 40*d* are formed on inner edges of a depression 40*e* (FIG. 1) in the top of the base plate. Guide surfaces 40*c* and 40*d* are parallel to, and closely adjacent to, guide surfaces 40*a* and 40*b*, respectively. Guide surfaces 40*c* and 40*d* are preferably part of the cover plate. These cooperating guide surfaces restrain the cam plate to its motion normal to the gripping edge. The cam plate includes a downwardly-directed lip 50.

The cover plate has a lateral slot that permits motion of a cam pin to be described. Stop pins 43,44 fixed to the base plate fit in slots 45,46 (also normal to the gripping edges) assure that the cam plate will be normal to the edge at the end of its travel, both inwardly and outwardly. Thus, the cam plate is free to move normally to the edge, and is assured to be aligned when opened and closed.

An actuator is a centrally mounted ring shaped rotor 51 fitted onto a circular wall 5 for rotation in it. It includes a pair of cam pins 54,55, and a pair of handles 56,57. The handles extend far enough out to be pushed or pulled but not so far as to impede the use of the device.

The cam pins extend outwardly from the ring and upwardly into a respective cam slot, and also into the shot in the cover plate.

The cam slot includes cam surfaces 60,61, which are engaged by the pin so as to move the cam plate when the actuator ring is turned.

The backing surface 19 or the central portion 28 of the shroud will, of course, be rigid for strength and support and the sheet could be brought directly against them. Frequently a stiffly flexible pad 65 (FIG. 6) will be placed directly against the metal surface, and the sheet drawn against the pad. In such event, pad 65 will be regarded as the backing surface, performing the same functions as that of backing the sheet.

Mounting screws 66 secure the holder to the sander. They extend through holes 76 in the plate.

Figure 6:
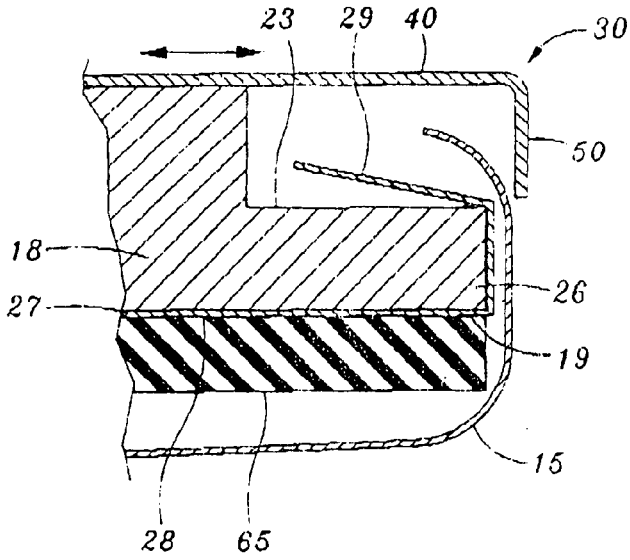
FIG. 6 is a fragmentary end view of the tensioner.

As best shown in FIG. 6, the lower edge of lip 50 is the gripping edge that engages the sheet and draws it over a strip such as strip 23. The metal strip is quite rigid. Unless some flexibility of the cover plate at the lip is allowed as shown in FIG. 3, there must be some dimensional allowance.

The shroud can provide for this by its flanges 29. These flanges are stiffly flexible, and the lip and cam plate can be rigid, because as the lip draws the sheet toward the center, it springly deflects the flange, resulting in a tight grip on the sheet. This is the preferred embodiment. Both arrangements are shown in the drawings.

The operation of this device will now be described. In FIG. 2, sheet 15 has its edges loosely inserted between the lip on this cam plate and the edge of the base plate. The ring has been turned to move the cam plate outwardly to create a sufficient opening for the edges of the sheet to be inserted.

As shown in FIG. 3, the rotor is then turned by pushing on the handles, and the cam pins force the cam plates inwardly. The lip on the cam plate (which may be a serrated edge), grips the sheet and draws it toward the center. The sheet is thereby strongly held flat against the backing surface.

The sheet is released by turning the ring in the reverse direction. The cam pin will then push the cam plate out, which will take the sheet edge with it and release it.

The embodiment as shown and described is preferred because the cam action draws both edges of the sheet at the same time. Included in this invention is to provide a separate clamp at one edge, and the described gripper only at the other edge. The same cam action, but only at one side, is provided, but will tighten and hold the sheet. For example, FIG. 7 shows an alternate embodiment gripper 31*a* in place of gripper 31 as shown in FIG. 1

Figure 7:
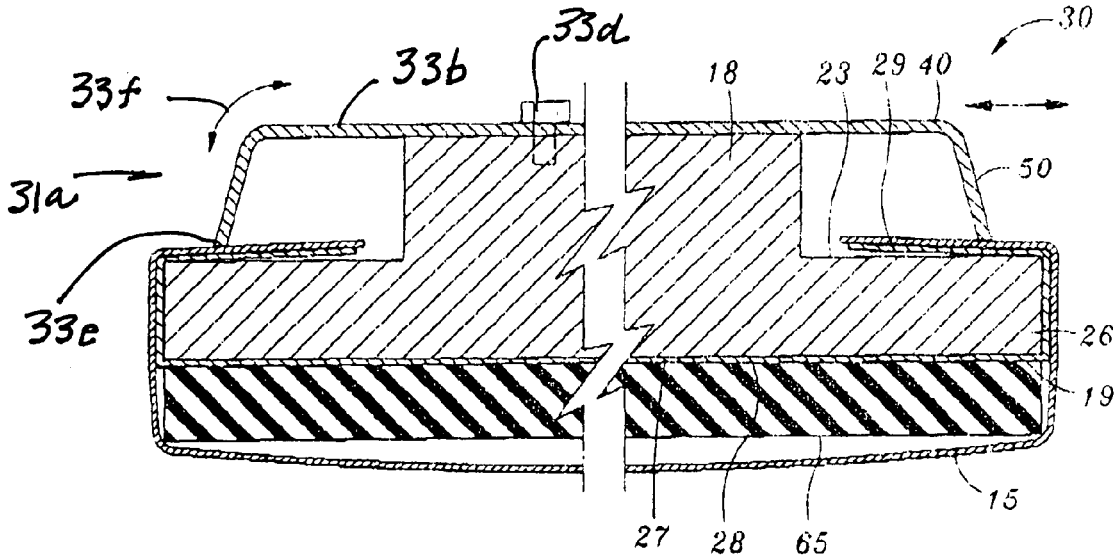
FIG. 7 is a fragmentary end view showing an alternative embodiment of the invention.

In FIG. 7, gripper 30 functions as it does in FIG. 1. Arrow 30*a* shows that its movement is lateral to the central axis. In contrast to FIG. 1, in which cam plate 32 slides laterally, plate 33*b* (FIG. 7) is fixed by a schematically illustrated restraint 33*d* which in the illustration is a bolt so the free edge 33*e* of cam plate 33*b* can be raised and lowered as shown by arcuate arrow 33*f*, but not moved laterally.

Thus, while gripper 30 operates as shown in FIG. 1, the free end 33*e* of gripper 31*a*, acting as a fixed clamp can be raised or lowered to admit or to grip the respective edge of the sheet.

This is an elegantly simple device, made of rugged parts that can resist the vigorous forces of sanders. The sheet can readily be removed and replaced, with only minimal contact with them.

This invention is not to be limited by the embodiment shown in the drawings and described in the description, which is given by way of example and not of limitation, but only in accordance with the scope of the appended claims.

We claim:

1. A holder to engage and hold tightly in place a sheet of abrasively-faced material, said holder comprising;

a base plate having a flat bottom backing surface with a pair of parallel side edges, with a gripping surface adjacent to each side edge;

a gripper adjacent to and extending along each of said side edges, said gripper comprising a cam plate mounted to an upper surface of said backing plate so as to be reciprocable normally to its respective side edge, each said cam plate including a downwardly-directed lip and including a cam slot so disposed and arranged as to react with a cam pin to move the cam plate and its lip toward and away relative to its respective side edge;

an actuator comprising a rotor rotatably mounted to said base plate, a said cam pin being mounted to said rotor and inserted into each cam slot, and a handle for turning the rotor;

whereby with the rotor in one position with the cam pins said cam slots positioning said cam plate to place its lip spaced from the respective flange to admit an edge of the sheet, the rotor can be turned to move the cam pins and cause the cam plates to move inwardly, with the flanges engages to the sheet, thereby drawing the edges of the sheet toward one another to tighten the sheet against the base plate.

2. A holder according to claim 1 in which a springly flange overlaps each of said gripping surfaces against which said lip presses the sheet when it tightens the sheet.

3. A holder according to claim 2 in which said rotor is a ring mounted by a wall on the base plate.

4. A holder according to claim 2 in which said base plate includes a base pad, whose surface forms said backing surface.

5. A holder according to claim 4 in which said lip is springly deflectable.

6. A holder according to claim 1 in which a cover plate is placed over said cam plate to confine said cam plate to said base plate.

7. A holder according to claim 1 in which said cam plate includes a plurality of slots normal to said edges, and a stop pin fixed to said base plate fitted in said guide slots to limit the movement of the cam plate to a motion normal to the respective edge of the backing plate and to ensure that its respective cam plate is parallel to its respective side edge at the extremes of its inward and outward movements.

8. A holder according to claim 7 in which a said cover plate is placed over said cam plate to confine said cam plate to said base plate.

9. A holder according to claim 1 in which said base plate adjacent to each said edge includes a pair of guide surfaces normal to said edge, and said cam plate includes a pair of complementary guide surfaces to restrain the movement of said plate to normal to said side edges.

10. A holder according to claim 9 in which said cam plate includes a plurality of slots normal to said edges, and a stop pin fixed to said base plate fitted in said guide slots to limit the movement of the cam plate to a motion normal to the respective edge of the backing plate and to ensure that its respective cam plate is parallel to its respective side edge at the extremes of its inward and outward movement.

11. A holder according to claim 1 in which the gripper at one edge is substituted by a fixed clamp.

* * * * *